US006260901B1

(12) United States Patent
Torefors

(10) Patent No.: US 6,260,901 B1
(45) Date of Patent: Jul. 17, 2001

(54) BRACKET FOR CLAMPING ARTICLES

(75) Inventor: Håkan Torefors, Hillerstorp (SE)

(73) Assignee: Torestorps Trad AB, Hillerstorp (SE)

( * ) Notice: Subject to any disclaimer, the term of this patent is extended or adjusted under 35 U.S.C. 154(b) by 0 days.

(21) Appl. No.: 09/330,747

(22) Filed: Jun. 11, 1999

(51) Int. Cl.[7] ..... B66C 1/44

(52) U.S. Cl. ..... 294/99.1; 248/309.1; 294/92

(58) Field of Search ..... 294/1.1, 82.1, 294/86.4, 90, 92, 99.1; 118/500, 503; 248/441.1, 445, 450, 451, 453, 459, 460, 473, 309.1, 317; 403/397

(56) References Cited

U.S. PATENT DOCUMENTS

| | | | | |
|---|---|---|---|---|
| D. 256,203 | * | 8/1980 | Brothers | 248/473 X |
| 1,399,507 | * | 12/1921 | Mills | 248/459 |
| 1,681,527 | * | 8/1928 | Egan | 248/473 |
| 2,550,857 | * | 5/1951 | Overbaugh | 248/459 |
| 3,402,909 | * | 9/1968 | Ely | 294/92 X |
| 3,744,449 | * | 7/1973 | Guttman et al. | 294/92 X |
| 4,976,483 | * | 12/1990 | Cunningham | 294/92 |
| 5,058,850 | * | 10/1991 | Glick | 248/450 |

FOREIGN PATENT DOCUMENTS

| | | |
|---|---|---|
| 526 725 | 9/1972 | (CH) . |
| 1343271 | 10/1963 | (FR) . |
| 1 338 841 | 3/1975 | (GB) . |
| 396 802 | 10/1977 | (SE) . |

* cited by examiner

*Primary Examiner*—Johnny D. Cherry
(74) *Attorney, Agent, or Firm*—Rader, Fishman, Grauer & McGarry

(57) ABSTRACT

A bracket for engagement with an object of a substantially rigid sheet-like material has a V- or U-shaped body portion that is produced from a spring material. The body portion has two shanks, and in each shank there is a recess. Each recess is open to an edge of the shank. The recesses have opposing abutment surfaces, and one of the abutment surfaces is on a flap extending from the shank. One or more tips project from any of the abutment surfaces to establish a point contact with sheet material to hold it. When the opposing abutment surfaces are in line with each other, a look-through region between the abutment surfaces increases when the shanks are moved relative to one another against the spring bias to enable positioning the material therebetween.

30 Claims, 5 Drawing Sheets

BRACKET FOR CLAMPING ARTICLES

TECHNICAL FIELD

The present invention relates to a bracket for engagement with or securing on an object of substantially rigid or inflexible material of a predetermined thickness.

Background Art

In the surface treatment of objects, such as sheet metal parts, aluminum profiles etc., these are suspended in hooks which hang in a row on a conveyor. When the objects which are to be surface treated are immersed in a bath, it happens on many occasions that the objects begin to float, since air may have been entrapped in pockets, cavities etc. At worst, this may result in the object coming loose from the hooks. For these parts not to come loose from the suspension members of the conveyor, it is important that they are held steadily clamped. Further, it is occasionally of interest that the abutment of the bracket against the object being surface treated is at a minimum. Moreover, the mounting of the brackets must be simple and not require any special tools.

Problem Structure

The present invention has for its object to realize a bracket which has a fast grip with a limited abutment against the gripped object and which may be mounted in place and removed by means of a single operation. Further objects of the present invention are to realize electric contact with the object and also to give low production costs and simple operation.

Solution

The objects forming the basis of the present invention will be attained if the bracket according to the present invention is characterized by an approximately V- or U-shaped body portion produced from resiliently yieldable material and having two shanks, a recess in each shank open towards one of its edges, the recesses having defining edges, and there being provided, in association with each recess, an abutment means opposite the defining edge, and the arrangement being such that, on placing of the defining edges in line with one another and with the eye of the observer, the shanks have, by bending away from or towards one another, a first position where a look-through region between the defining edges and the abutment means has a thickness which is greater than the predetermined thickness, and the shanks, after return springing, have a second position where the thickness of the look-through region is less than the predetermined thickness.

Further advantages will be attained according to the present invention if the bracket according to the invention is also given one or more of the characterizing features as set forth in the appended claims.

BRIEF DESCRIPTION OF THE ACCOMPANYING DRAWINGS

The present invention will now be described in greater detail hereinbelow, with particular reference to the accompanying drawings, in which.

DESCRIPTION OF PREFERRED EMBODIMENT

Figure 1:
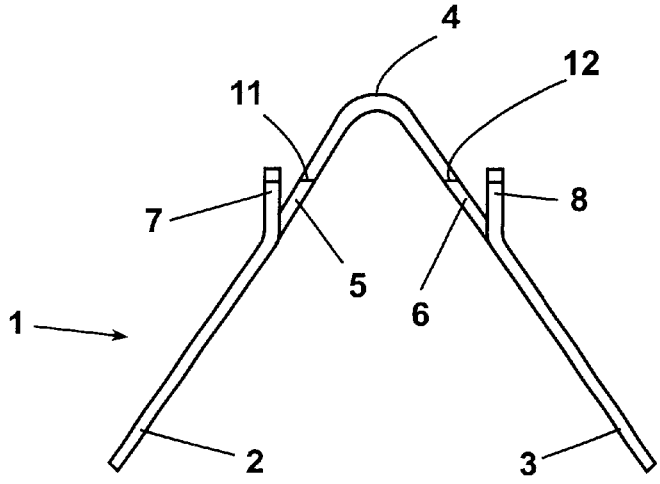
FIG. 1 is a straight side elevation of the bracket according to the present invention in its free position.
Figure 10:
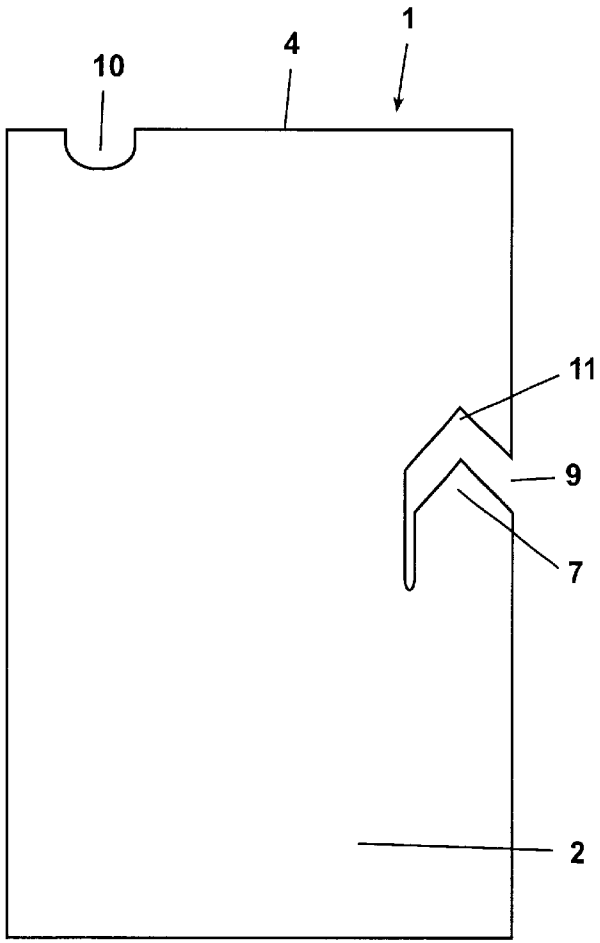
FIG. 10 is a view corresponding to that of FIG. 3, showing another embodiment of the bracket according to the present invention.
Figure 9:
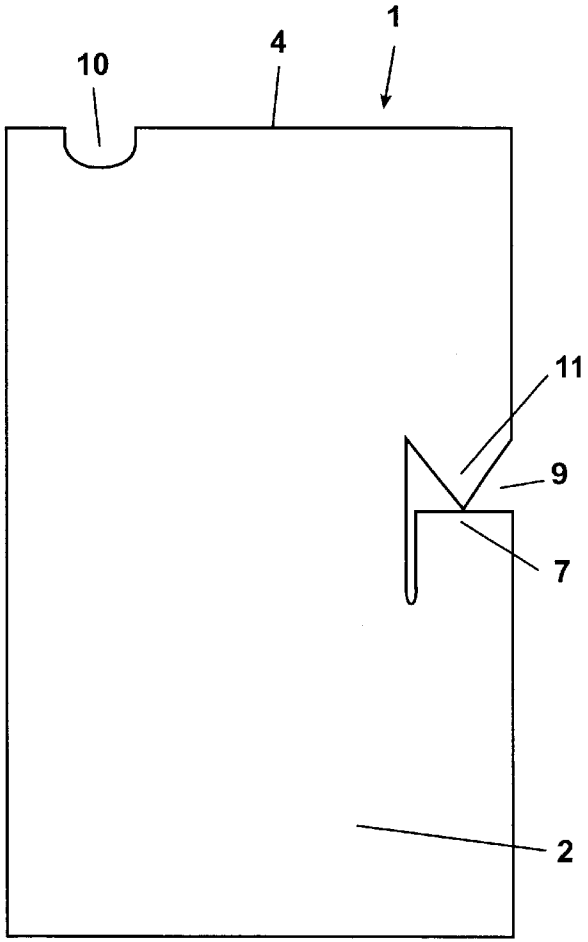
FIG. 9 is a view corresponding to that of FIG. 3, showing another embodiment of the bracket according to the present invention.

FIG. 1 shows a bracket which is intended to retain or be secured on objects such as aluminum profiles and sheet metal parts when these are to undergo some form of surface treatment. The bracket comprises a body portion 1 which is approximately V- or U-shaped. The body portion 1 has two shanks 2 and 3 which are united at a tip 4 which may be more or less obtuse and rounded. In each one of the shanks 2, 3, there is a recess 5, 6 open towards the edge of the shanks, and abutment means 7, 8. The recesses have defining edges 11, 12, and the abutment means 7 and 8 are disposed on the opposite side of each recess 5, 6. The defining edges 11 and 12 may, as in FIGS. 1–8, be straight but may, for example, be provided with at least one tip or projection which abuts against the object which is fixedly clamped in the bracket (see FIG. 9). Alternatively, as in FIG. 10, the defining edges 11 and 12 can be concavely arched. In the figures, the abutment means are bent flaps in one piece with the body portion.

Figure 2:
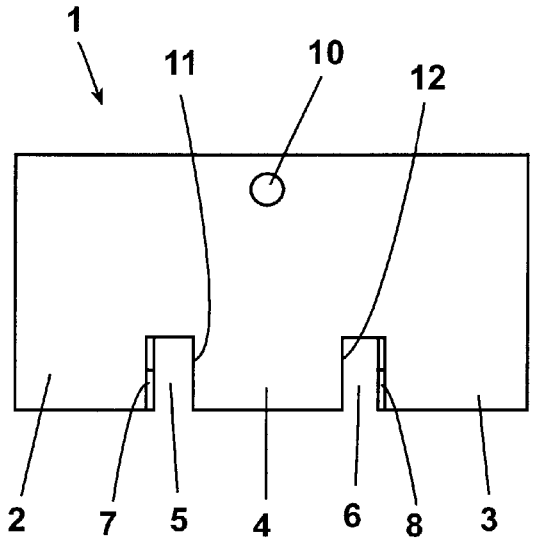
FIG. 2 is a straight top plan view of the bracket of FIG. 1.
Figure 4:
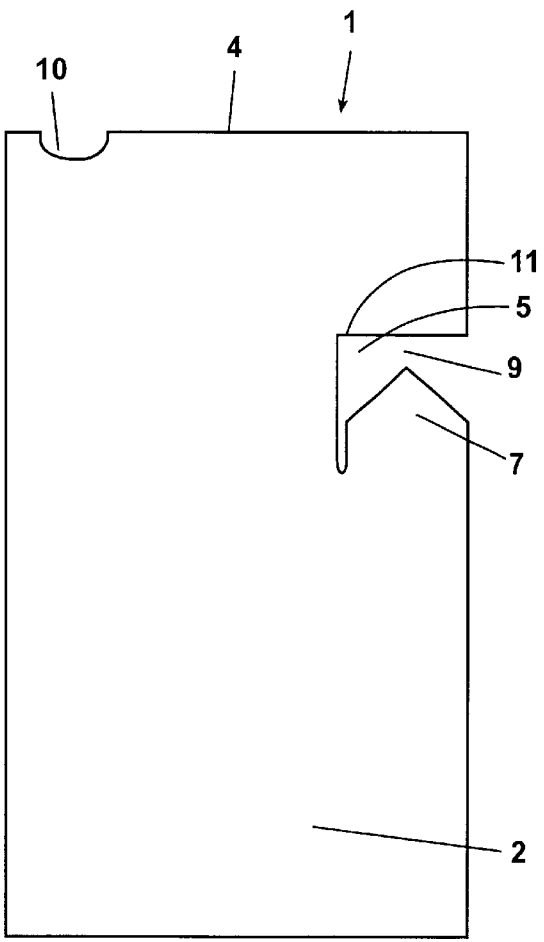
FIG. 4 is a view corresponding to that of FIG. 3, the bracket according to the present invention being, however, in its loaded state.
Figure 3:
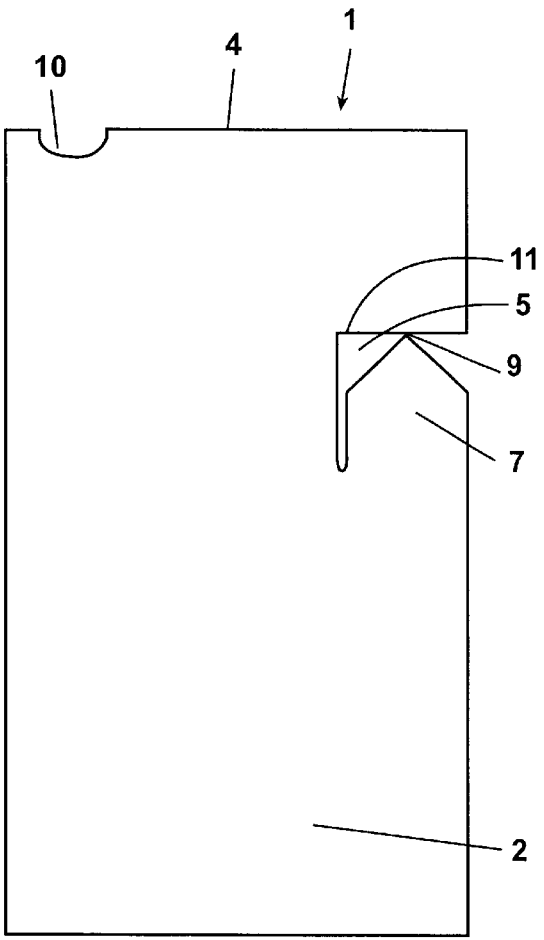
FIG. 3 is a straight side elevation from the left of the bracket of FIG. 1 in its free position.

In the body portion, there is also provided a suspension arrangement 10 which is intended for suspension in hooks or the like. In FIGS. 2, 3 and 4, the suspension arrangement 10 is in the form of a hole and is disposed in the tip 4 of the body portion. A number of other designs of the suspension arrangement 10 are conceivable, as well as a number of other platings of the suspension arrangement, for example somewhere in the shanks 2, 3.

Figure 5:
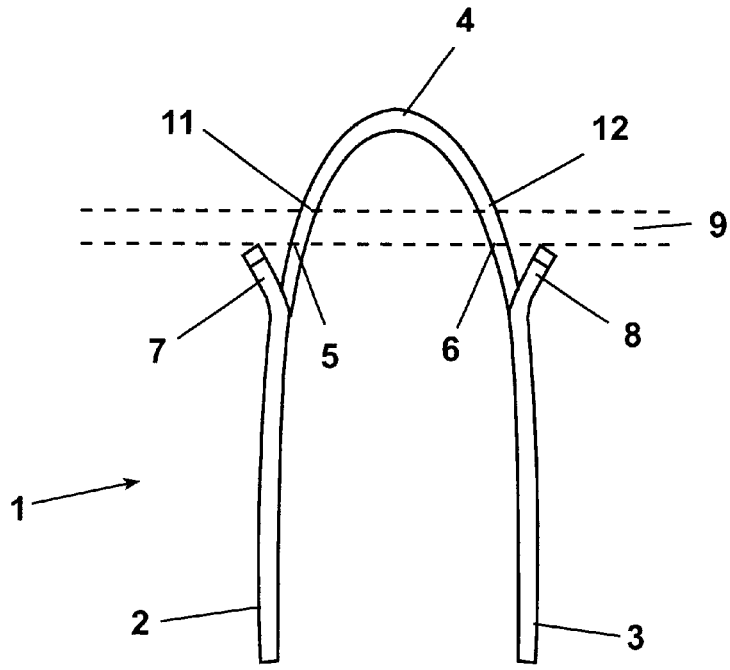
FIG. 5 is a view corresponding to that of FIG. 1, the bracket according to the present invention being, however, in its loaded state.

FIG. 4 shows the bracket when its shanks are moved towards one another, for example in that they are compressed together by manual force. The shanks 2 and 3 are bent and the bending will be at its greatest flush with the recesses 5, 6. The angle between the abutment means 7, 8 and the shanks 2, 3 is largely unchanged. Because of the geometry of the bracket, the compression of the shanks 2 and 3 will entail that the space 9, the look-through space, which is visible when the recesses 5, 6, the abutment means 7, 8 and the eye of the observer lie on an approximately straight line, becomes greater. This is particularly visible when FIGS. 3 and 4 are compared with each other. FIG. 5 shows the bracket according to FIG. 1 in its loaded position, with the look-through region 9 marked by broken lines. When the loading on the shanks 2, 3 is once again reduced, the space 9 between the wall of the recesses 5, 6 and the abutment means 7, 8 is also reduced.

If a sheet metal part of a predetermined thickness or the like is inserted in the space 9 when the bracket is compressed, this object will be retained in position when the bracket has reassumed its free state, on condition that the object is of sufficient thickness, rigidity and is otherwise of a suitable geometric configuration. In unfortunate circumstances, greatly curved objects may be of such a configuration that they may be inserted into and removed from the bracket when this is in its unloaded state. Such is also the case for flexible objects.

The abutment means 7, 8—which in many cases are designed as flaps—abut against the object in a plurality of points. It is often desirable that these points of contact be as few as possible in number. For this reason, the flaps may advantageously be designed such that they include at least one tip which is intended to abut against the clamped object. The recesses may also be provided with tips so that these abut against the clamped object.

A suitable production material for the bracket is, in many cases, spring sheet metal, at least in those cases where the sheet is of sufficient thickness and the metal displays such material properties that the bracket will have a sufficiently high degree of elasticity to be able to spring back after loading, at the same time as the clamped object is to be retained in position until the bracket is once again compressed. Another advantage inherent in manufacturing the bracket from sheet metal is that it is electrically conductive, which may be utilized, for example, in powder spraying. It is also conceivable that the bracket be manufactured from some type of plastic, on condition that the plastic possesses such properties that the clamping function of the bracket is retained.

Description of Alternative Embodiments

Figure 6:
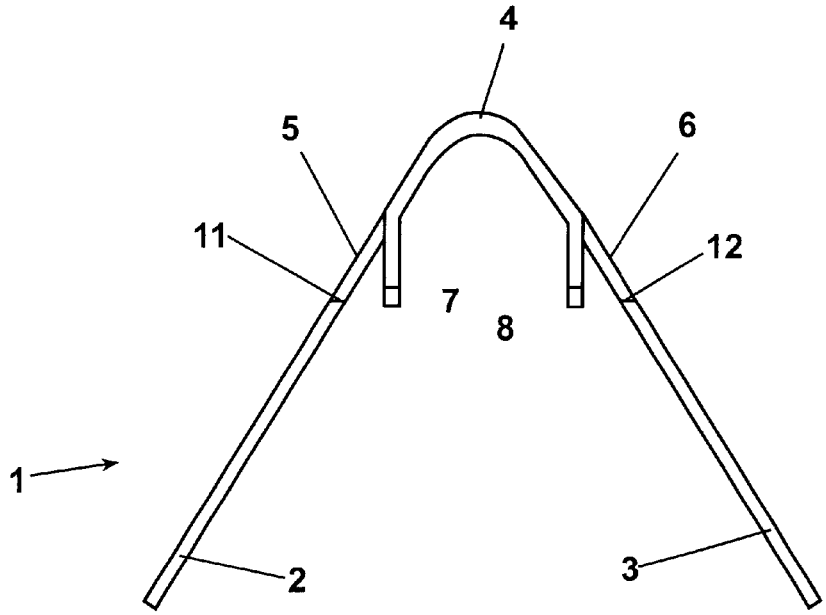
FIG. 6 is a view corresponding to that of FIG. 1, showing an alternative embodiment of the bracket according to the present invention in its free position.

As was mentioned previously, the abutment means 7, 8 may be given a different appearance than that described in the foregoing. FIG. 6 shows one embodiment which is equivalent to that shown in FIGS. 1–5. The difference is that the abutment means 7, 8 in the form of flaps have been bent inwards in the region between the shanks 2, 3. In order for the desired effect with an increased space 9 between the recesses 5, 6 and the abutment means 7, 8 to be achieved when the shanks 2, 3 are moved towards one another, the flaps have, for geometric reasons, been reversed so that they point away from the tip 4 of the bracket. One advantage with this embodiment is that the flaps 7, 8, which may have sharp corners or edges, are turned to face inwards so that the risk of personal injury or damage to objects is reduced.

Figure 7:
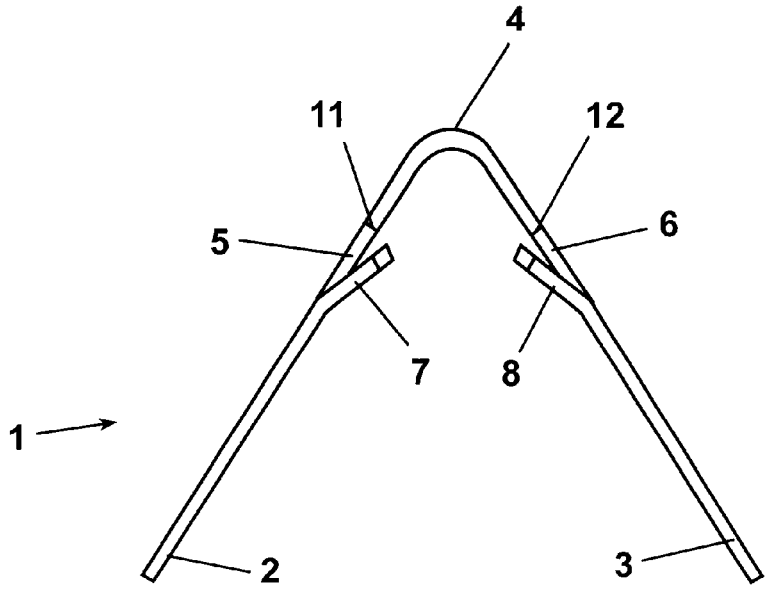
FIG. 7 is a view corresponding to that of FIG. 1, showing yet a further embodiment of the bracket according to the present invention in its free position.
Figure 8:
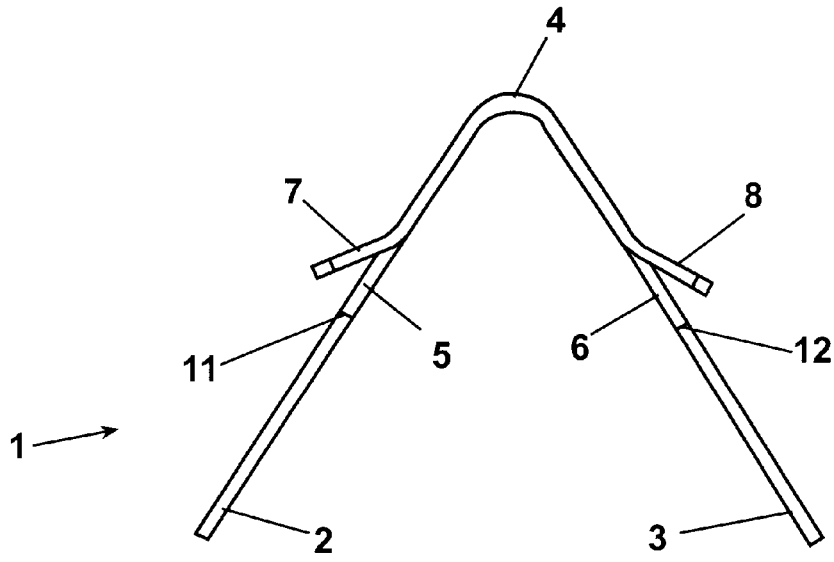
FIG. 8 is a view corresponding to that of FIG. 1, showing a fourth embodiment of the bracket according to the present invention in its free position.

A third embodiment is shown in FIG. 7. Also in this embodiment, the flaps 7, 8 are turned to face inwards towards the region between the shanks 2, 3. In order for the space 9 between the recesses 5, 6 and the abutment means 7, 8 to increase so that an object may be fixedly clamped, the shanks 2 and 3 must be moved away from one another. This embodiment may be of interest in such cases when it is not desired that the bracket releases its grip if the shanks 2 and 3 are inadvertently moved towards one another. For the sake of completeness, the embodiment according to FIG. 8 has also been included. In this embodiment, the flaps 7, 8 are bent outwards and are directed away from the tip 4. In order for the bracket to reach the position in which objects may be fixedly clamped, the shanks 2 and 3 must be moved away from one another.

The invention may also be modified further in order to be made suitable for other fields of use as well. For example, the bracket may be placed on the longitudinal sides of the shanks 2, 3 which are opposite the recesses so that a sign or the like may be secured in the recesses 5, 6.

Another possibility is to provide the ends of the shanks 2, 3 with thermally insulating handles of some form, so that the bracket, either alone or in pair with another bracket, may be employed in the handling of objects at high temperatures.

What is claimed is:

1. A bracket for engagement with an object of substantially rigid or inflexible sheet-shaped material for surface treatment, the bracket comprising a substantially V- or U-shaped body portion (1) produced from resiliently yieldable material and having two shanks (2, 3), and a recess (5, 6) in each shank (2, 3) open towards an edge of the shank, the recesses having defining edges, (11, 12), and abutment means (7, 8) opposite the defining edges (11, 12), wherein the defining edges and the abutment means are arranged such that a look-through region (9) between the defining edges (11, 12) and the abutment means (7, 8), when the defining edges are aligned with each other and the abutment means are aligned with each other, increases when the shanks are moved relative to each other, one of the defining edge and abutment means associated with each recess having at least one tip to obtain a point contact with a sheet-shaped material.

2. The bracket as claimed in claim 1, characterized in that the defining edges (11, 12) are transversely directed in relation to the shank edge.

3. The bracket as claimed in claim 2, characterized in that the abutment means (7, 8) comprise flaps which make an angle with the plane of each respective shank (2, 3).

4. The bracket as claimed in claim 1, characterized in that the abutment means (7, 8) comprise flaps which make an angle with the plane of each respective shank (2, 3).

5. The bracket as claimed in claim 4, characterized in that each one of the flaps (7, 8) includes at least one tip.

6. The bracket as claimed in claim 5, characterized in that the tips of the flaps are directed towards the area between the shanks (2, 3).

7. The bracket as claimed in claim 5, characterized in that the tips of the flaps are directed away from the area between the shanks (2, 3).

8. The bracket as claimed in claim 5, characterized in that the flaps (7, 8) are bent inwards towards the region between the shanks (2, 3).

9. The bracket as claimed in claim 5, characterized in that the flaps (7, 8) are bent outwards away from the region between the shanks (2, 3).

10. The bracket as claimed in claim 1, characterized in that the defining edges (11, 12) comprise tips.

11. The bracket as claimed in claim 10, characterized in that the defining edges (11, 12) are transversely directed in relation to the shank edge.

12. The bracket as claimed in claim 11, characterized in that the abutment means (7, 8) comprise flaps which make an angle with the plane of each respective shank (2, 3).

13. The bracket as claimed in claim 12, characterized in that each one of the flaps (7, 8) includes at least one tip which, on engagement with the object, abuts against it.

14. The bracket as claimed in claim 10, characterized in that the bracket is manufactured from an electrically conductive material.

15. The bracket as claimed in claim 1, characterized in that the defining edges (11, 12) are arched in concave fashion away from the tip of the flaps.

16. The bracket as claimed in claim 15, characterized in that the defining edges (11, 12) are transversely directed in relation to the shank edge.

17. The bracket as claimed in claim 16, characterized in that the abutment means (7, 8) comprise flaps which make an angle with the plane of each respective shank (2, 3).

18. The bracket as claimed in claim 17, characterized in that each one of the flaps (7, 8) includes at least one tip.

19. The bracket as claimed in claim 1, characterized in that the bracket includes means (10) for suspension.

20. The bracket as claimed in claim 1, characterized in that the bracket is manufactured from an electrically conductive material.

21. A bracket for securely holding a substantially rigid object having a predetermined dimension, the bracket comprising:

a generally V- or U-shaped body portion formed of material with a spring bias and having two shanks:

each shank having an edge with a recess in the shank open to the shank edge, and each recess having a first abutment surface; and a flap disposed on the shank opposite the first abutment surface and having a second abutment surface spaced from the first abutment surface;

wherein upon movement of the shanks relative to each other against the spring bias, a space is defined between a first plane comprising the first abutment surfaces and a second plane comprising the second abutment surfaces, the distance between the first and second planes being greater than the predetermined dimension in a first position of the shanks, and the distance between the first and second planes being less than the predetermined dimension in a second position of the shanks;

whereby when the shanks are in the first position, a substantially rigid object with the predetermined dimension can be received in the recess through the shank edge and when the shanks are in the second position, the object will be clamped between the first and second abutment surfaces.

22. The bracket as claimed in claim 21 wherein the flaps extend at an angle relative to each respective shank.

23. The bracket as claimed in claim 22 wherein the flaps extend toward the area between the shanks.

24. The bracket as claimed in claim 22 wherein the flaps extend away from the area between the shanks.

25. The bracket as claimed in claim 21 wherein the first abutment surface is a defining edge of the recess.

26. The bracket as claimed in claim 21 wherein the recess has a defining edge and the first abutment surface is at least one tip projecting from the defining edge.

27. The bracket as claimed in claim 21 wherein the second abutment surface is at least one tip projecting from the flap.

28. The bracket as claimed in claim 27 wherein the defining edges are arched in concave fashion away from the tip of the flaps.

29. The bracket as claimed in claim 21 wherein the bracket includes means for suspension.

30. The bracket as claimed in claim 21 wherein the bracket is manufactured from an electrically conductive material.

* * * * *